US010017354B2

(12) United States Patent
Ginsberg et al.

(10) Patent No.: US 10,017,354 B2
(45) Date of Patent: Jul. 10, 2018

(54) CONTROL SYSTEM FOR MULTICAR ELEVATOR SYSTEM

(71) Applicant: OTIS ELEVATOR COMPANY, Farmington, CT (US)

(72) Inventors: David Ginsberg, Granby, CT (US); Arthur Hsu, South Glastonbury, CT (US); Jose Miguel Pasini, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 6 days.

(21) Appl. No.: 15/205,307

(22) Filed: Jul. 8, 2016

(65) Prior Publication Data

US 2017/0008729 A1 Jan. 12, 2017

Related U.S. Application Data

(60) Provisional application No. 62/190,850, filed on Jul. 10, 2015.

(51) Int. Cl.

| | |
|---|---|
| ***B66B 1/28*** | (2006.01) |
| ***B66B 9/00*** | (2006.01) |
| ***B66B 1/24*** | (2006.01) |
| *B66B 11/04* | (2006.01) |

(52) U.S. Cl.

CPC ..... *B66B 1/28* (2013.01); *B66B 1/2491* (2013.01); *B66B 9/003* (2013.01); *B66B 11/0407* (2013.01)

(58) Field of Classification Search

CPC ..... B66B 1/2491; B66B 9/003; B66B 1/28; B66B 11/0407

USPC ..... 187/247

See application file for complete search history.

(56) References Cited

U.S. PATENT DOCUMENTS

| | | | | |
|---|---|---|---|---|
| 1,939,729 | A * | 12/1933 | Stark | B66B 9/00 187/249 |
| 4,004,654 | A * | 1/1977 | Hamy | B66B 9/003 104/127 |
| 4,029,175 | A | 6/1977 | Winkler | |
| 4,114,730 | A | 9/1978 | Means et al. | |
| 4,821,845 | A * | 4/1989 | DeViaris | B66B 7/021 104/307 |
| 5,090,515 | A | 2/1992 | Takahashi et al. | |

(Continued)

FOREIGN PATENT DOCUMENTS

| | | | | |
|---|---|---|---|---|
| CA | 2512569 | A1 * | 1/2006 | B66B 1/2466 |
| CA | 2942748 | A1 * | 10/2015 | B66B 9/003 |

(Continued)

OTHER PUBLICATIONS

European Search Report for application EP 16178871.6, dated Dec. 15, 2016, 8 pages.

*Primary Examiner* — David Warren
(74) *Attorney, Agent, or Firm* — Cantor Colburn LLP

(57) ABSTRACT

An elevator system includes an elevator car to travel vertically in a first lane and a second lane; a propulsion system to impart force to the elevator car; a transfer station to move the elevator car horizontally from the first lane to the second lane; and a control system to supervise travel of the elevator car, the control system to supervise a first intersection between the first lane and the transfer station such that no more than one of vertical elevator car travel and horizontal elevator car travel is permitted at the first intersection at a given time.

19 Claims, 8 Drawing Sheets

(56) References Cited

U.S. PATENT DOCUMENTS 5,601,156 A * 2/1997 McCarthy ..... B66B 9/00 187/249
5,651,426 A * 7/1997 Bittar ..... B66B 1/2458 187/249
5,752,585 A * 5/1998 Bittar ..... B66B 1/2458 187/249
5,758,748 A * 6/1998 Barker ..... B66B 9/00 187/249
5,861,586 A * 1/1999 McCarthy ..... B61B 15/00 187/249
5,865,274 A 2/1999 Kiji et al.
5,924,524 A * 7/1999 Barker ..... B66B 1/2458 182/12
6,315,082 B2 11/2001 Hikita
6,955,245 B2 10/2005 Duenser et al.
7,487,860 B2 2/2009 Hikita et al.
7,621,376 B2 11/2009 Duenser et al.
8,348,018 B2 1/2013 Kostka
8,602,168 B2 12/2013 Tschuppert
9,598,265 B1 * 3/2017 Jacobs ..... B66B 9/003
2003/0217893 A1 * 11/2003 Dunser ..... B66B 1/2466 187/249
2006/0016640 A1 1/2006 Duenser et al.
2006/0163008 A1 * 7/2006 Godwin ..... B66B 9/00 187/288
2011/0042168 A1 2/2011 Grundmann
2014/0190774 A1 7/2014 Hsu et al.
2016/0075533 A1 * 3/2016 Scomparin ..... B66B 9/003 187/240
2016/0304316 A1 * 10/2016 Witczak ..... B66B 11/0407
2016/0304317 A1 * 10/2016 Witczak ..... B66B 11/04
2017/0008729 A1 * 1/2017 Ginsberg ..... B66B 1/28
2017/0015524 A1 * 1/2017 Fargo ..... B66B 11/0407
2017/0057780 A1 * 3/2017 Nguyen ..... B66B 1/3446
2017/0057784 A1 * 3/2017 Witczak ..... B66B 7/02
2017/0057786 A1 * 3/2017 Witczak ..... B66B 7/046
2017/0057790 A1 * 3/2017 Roberts ..... B66B 11/0273
2017/0057792 A1 * 3/2017 Dwari ..... B66B 11/0407
2017/0066623 A1 * 3/2017 Kuczek ..... B66B 1/28
2017/0073183 A1 * 3/2017 Ginsberg ..... B66B 5/06
2017/0088395 A1 * 3/2017 Roberts ..... B66B 5/0031
2017/0088396 A1 * 3/2017 Fargo ..... B66B 1/32
2017/0088398 A1 * 3/2017 Kuczek ..... B66B 5/044
2017/0158461 A1 * 6/2017 Roberts ..... B66B 1/30
2017/0190544 A1 * 7/2017 Witczak ..... B66B 1/468
2017/0233218 A1 * 8/2017 Zheng ..... B66B 1/2491
2017/0240385 A1 * 8/2017 Fargo ..... B66B 11/0446

FOREIGN PATENT DOCUMENTS

EP 0499254 A1 * 8/1992 ..... B66B 9/003
EP 1367018 A2 12/2003
GB 2277611 A 11/1994
JP H05124781 A 5/1993
WO WO 2012154178 A1 * 11/2012 ..... B66B 9/003

* cited by examiner

CONTROL SYSTEM FOR MULTICAR ELEVATOR SYSTEM

CROSS-REFERENCE TO RELATED APPLICATIONS

This application claims the benefit of U.S. provisional patent application Ser. No. 62/190,850, filed Jul. 10, 2015, the entire contents of which are incorporated herein by reference.

TECHNICAL FIELD

The subject matter disclosed herein relates generally to the field of elevators, and more particularly to a control system for a multicar, self-propelled elevator system.

BACKGROUND

Self-propelled elevator systems, also referred to as ropeless elevator systems, are useful in certain applications (e.g., high rise buildings) where the mass of the ropes for a roped system is prohibitive and there is a desire for multiple elevator cars to travel in a single lane. There exist self-propelled elevator systems in which a first lane is designated for upward traveling elevator cars and a second lane is designated for downward traveling elevator cars. Existing self-propelled elevator systems may operate more than one elevator car in a lane, and have elevator cars traveling in different directions in a single lane. At least one transfer station is provided in the hoistway to move cars horizontally between a first lane and a second lane. As elevator cars enter and exit a horizontal transfer station, it is important that the elevator cars are controlled so as to not interfere with each other.

BRIEF DESCRIPTION

According to one embodiment, an elevator system includes an elevator car to travel vertically in a first lane and a second lane; a propulsion system to impart force to the elevator car; a transfer station to move the elevator car horizontally from the first lane to the second lane; and a control system to supervise travel of the elevator car, the control system to supervise a first intersection between the first lane and the transfer station such that no more than one of vertical elevator car travel and horizontal elevator car travel is permitted at the first intersection at a given time.

In addition to one or more of the features described above or below, or as an alternative, further embodiments could include wherein the control system is configured to supervise the first intersection such that neither of vertical elevator car travel and horizontal elevator car travel is permitted at the first intersection at a given time.

In addition to one or more of the features described above or below, or as an alternative, further embodiments could include wherein the control system is configured to supervise a second intersection between the second lane and the transfer station such that no more than one of vertical elevator car travel and horizontal elevator car travel is permitted at the second intersection at a given time.

In addition to one or more of the features described above or below, or as an alternative, further embodiments could include wherein the control system is configured to supervise the second intersection such that neither of vertical elevator car travel and horizontal elevator car travel is permitted at the second intersection at a given time.

In addition to one or more of the features described above or below, or as an alternative, further embodiments could include wherein the control system includes a lane supervisor to supervise vertical travel of the elevator car in the first lane and the second lane, a transfer supervisor to supervise horizontal travel in the transfer station and a group supervisor to command the lane supervisor and the transfer supervisor.

In addition to one or more of the features described above or below, or as an alternative, further embodiments could include wherein the group supervisor commands the transfer supervisor to disable a transfer zone in the first intersection prior to the elevator car vertically travelling into the first intersection.

In addition to one or more of the features described above or below, or as an alternative, further embodiments could include wherein the group supervisor commands the lane supervisor to enable the lane zone in the first intersection, to enable the elevator car to travel vertically into the first intersection.

In addition to one or more of the features described above or below, or as an alternative, further embodiments could include wherein the group supervisor commands the lane supervisor to disable the lane zone in the first intersection and commands the transfer supervisor to enable the transfer zone in the first intersection and enable a second intersection between the second lane and the transfer station, the elevator car traveling from the first intersection toward the second intersection.

In addition to one or more of the features described above or below, or as an alternative, further embodiments could include wherein the group supervisor commands the transfer supervisor to disable the transfer zone in the second intersection and commands the lane supervisor to enable a lane zone in the second intersection to enable the elevator car to travel vertically in the second lane.

According to another embodiment, a method of controlling an elevator system having an elevator car to travel vertically in a first lane and a second lane and a transfer station to move the elevator car horizontally from the first lane to the second lane includes controlling a first intersection between the first lane and the transfer station such that no more than one of vertical elevator car travel and horizontal elevator car travel is permitted at the first intersection at a given time.

In addition to one or more of the features described above or below, or as an alternative, further embodiments could include controlling the first intersection such that neither of vertical elevator car travel and horizontal elevator car travel is permitted at the first intersection at a given time.

In addition to one or more of the features described above or below, or as an alternative, further embodiments could include controlling a second intersection between the second lane and the transfer station such that no more than one of vertical elevator car travel and horizontal elevator car travel is permitted at the second intersection.

In addition to one or more of the features described above or below, or as an alternative, further embodiments could include controlling the second intersection such that neither of vertical elevator car travel and horizontal elevator car travel is permitted at the second intersection.

In addition to one or more of the features described above or below, or as an alternative, further embodiments could include disabling a transfer zone in the first intersection prior to the elevator car vertically travelling into the first intersection.

In addition to one or more of the features described above or below, or as an alternative, further embodiments could include enabling the lane zone in the first intersection, to enable the elevator car to travel vertically into the first intersection.

In addition to one or more of the features described above or below, or as an alternative, further embodiments could include disabling the lane zone in the first intersection and enabling the transfer zone in the first intersection and enabling a second intersection between the second lane and the transfer station, the elevator car traveling from the first intersection toward the second intersection.

In addition to one or more of the features described above or below, or as an alternative, further embodiments could include disabling the transfer zone in the second intersection and enabling a lane zone in the second intersection to enable the elevator car to travel vertically in the second lane.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
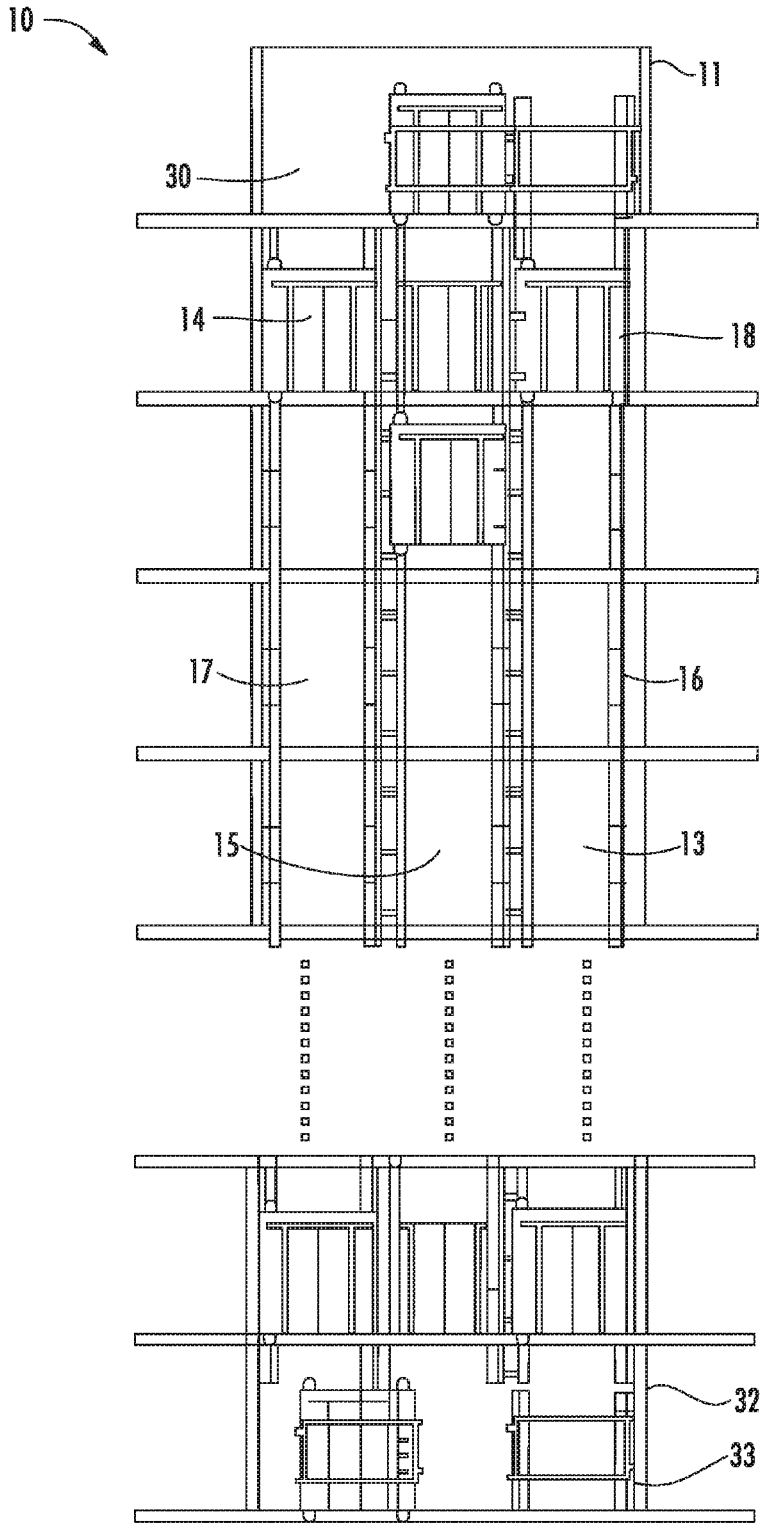
FIG. 1 depicts a multicar elevator system in an exemplary embodiment.

FIG. 1 depicts a multicar, self-propelled elevator system 10 in an exemplary embodiment. Elevator system 10 includes a hoistway 11 having a plurality of lanes 13, 15 and 17. While three lanes are shown in FIG. 1, it is understood that embodiments may be used with multicar, self-propelled elevator systems having any number of lanes. In each lane 13, 15, 17, elevator cars 14 may travel in one direction, i.e., up or down or in both directions, i.e. up and down. For example, in FIG. 1 elevator cars 14 in lanes 13 and 15 travel up and elevator cars 14 in lane 17 travel down. One or more elevator cars 14 may travel in a single lane 13, 15, and 17.

Above the top floor is an upper transfer station 30 to impart horizontal motion to the elevator cars 14 to move the elevator cars 14 between the lanes 13, 15 and 17. The use of the term "horizontal" includes substantially horizontal motion and may be equivalent to a sideways or laterally. It is understood that the upper transfer station 30 may be located at the top floor, rather than above the top floor. Below the first floor is a lower transfer station 32 to impart horizontal motion to the elevator cars 14 to move the elevator cars 14 between the lanes 13, 15 and 17. It is understood that the lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and the lower transfer station 32. Transfer stations 30 and 32 may use a carriage 33 to move the elevator car 14 in a horizontal direction. In other embodiments, no carriage is needed at the transfer stations 30 and 32, as the elevator cars 14 can be self-propelled from one lane to another.

The elevator cars 14 are propelled using a linear propulsion system having a fixed, primary portion 16 and a moving, secondary portion 18. The primary portion 16 includes windings or coils mounted at one or both sides of the lanes 13, 15 and 17. The secondary portion 18 includes permanent magnets mounted to one or both sides of the elevator cars 14. The primary portion 16 is supplied with drive signals to control movement of the elevator cars 14 in their respective lanes. In alternate embodiments, the primary portion 16 is mounted to one or both sides of the elevator cars 14 and the secondary portion 18 is mounted at one or both sides of the lanes 13, 15 and 17.

Figure 2:
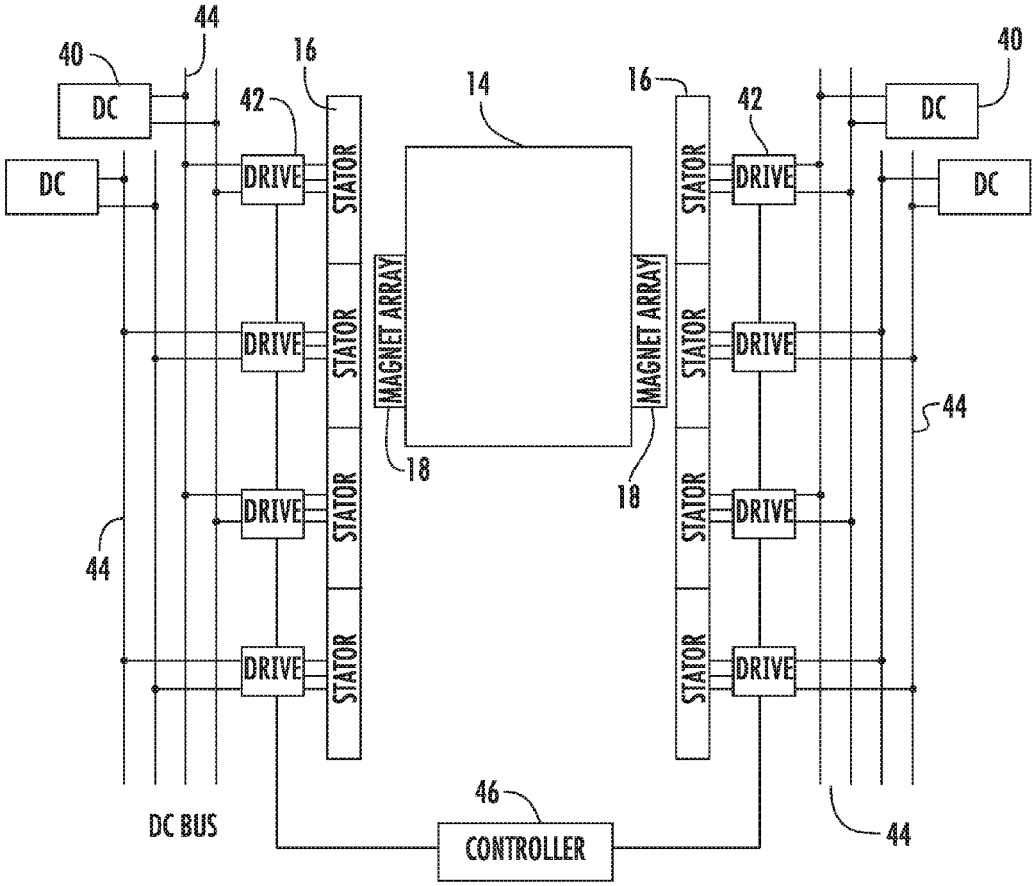
FIG. 2 depicts components of a drive system in an exemplary embodiment.

FIG. 2 depicts components of a drive system in an exemplary embodiment. It is understood that other components (e.g., safeties, brakes, etc.) are not shown in FIG. 2 for ease of illustration. FIGS. 1 and 2 depict one exemplary propulsion system using a linear motor. Embodiments may be used with other propulsion systems, such as a magnetic screw type propulsion system. As such, embodiments are not intended to be limited to the propulsion system shown in FIGS. 1 and 2.

As shown in FIG. 2, one or more power sources 40 are coupled to one or more drives 42 via one or more buses 44. In the example in FIG. 2, the power sources are DC power sources, but embodiments are not limited to using DC power. The DC power sources 40 may be implemented using storage devices (e.g., batteries, capacitors). The DC power sources 40 may be active devices that condition power from another source (e.g., rectifiers). The drives 42 receive DC power from the DC buses 44 and provide drive signals to the primary portions 16 of the linear propulsion system. Each drive 42 may be a converter that converts DC power from the DC bus 44 to a multiphase (e.g., 3 phase) drive signal provided to a respective section of the primary portions 16. The primary portion 16 is divided into a plurality of sections or zones, with each section associated with a respective drive 42.

A drive controller 46 provides control signals to each of the drives 42 to control generation of the drive signals. The drive controller 46 may use pulse width modulation (PWM) control signals to control generation of the drive signals by drives 42. The drive controller 46 may be implemented using a processor-based device programmed to generate the control signals. The drive controller 46 may also be part of an elevator control system or elevator management system. Elements of FIG. 2 may be implemented in a single, integrated module, or be distributed along the hoistway.

Figure 3:
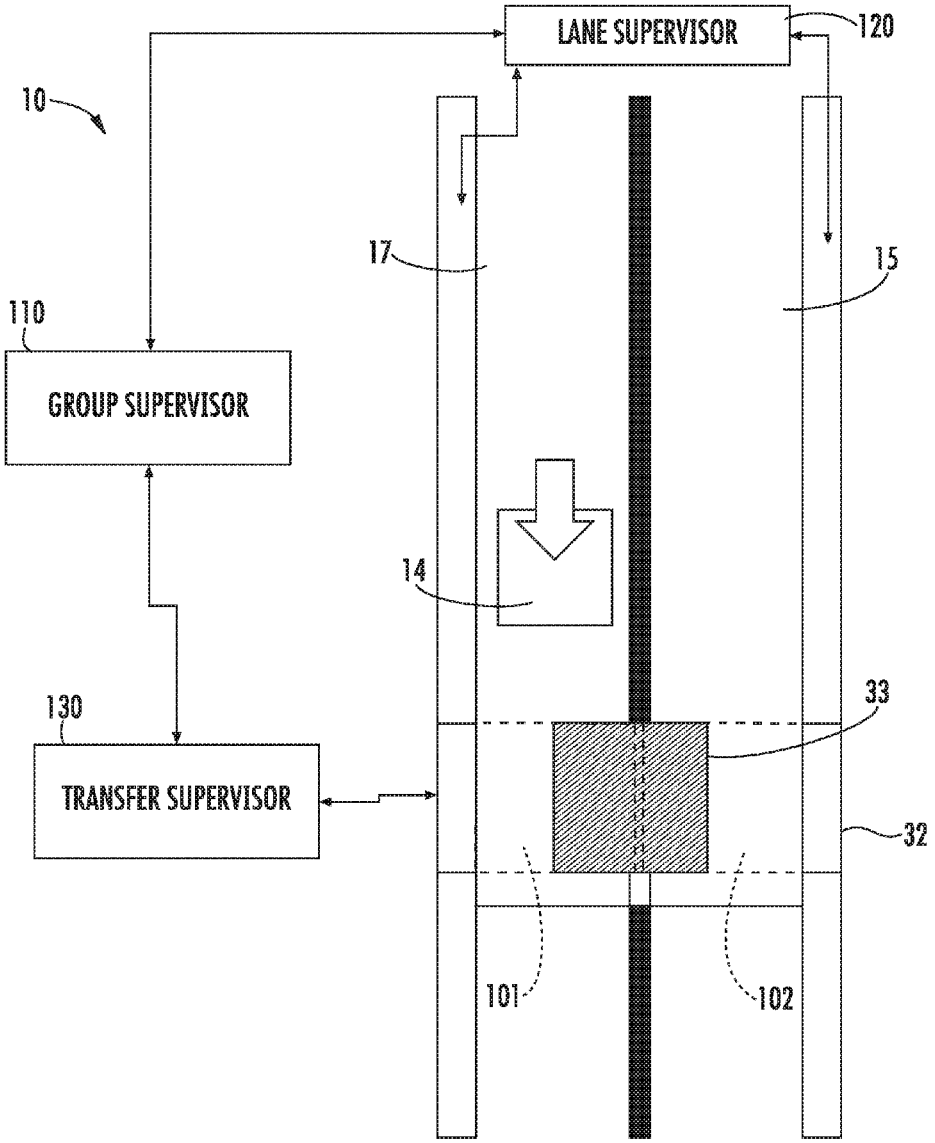
FIG. 3 depicts a control system for a self-propelled elevator system in an exemplary embodiment.

FIG. 3 depicts a control system for a self-propelled elevator system 10 in an exemplary embodiment. FIG. 3 depicts a first lane 17 and a second lane 15 and an elevator car 14 that travels vertically in each lane 17 and 15. The transfer station 32 provides bidirectional, horizontal movement of the elevator car 14 between lanes 17 and 15. It is understood that embodiments may be extended to additional lanes and transfer stations.

In order to supervise movement of the elevator cars 14 entering and exiting the transfer station 32, a control system includes a group supervisor 110, a lane supervisor 120 and a transfer supervisor 130. Each supervisor may be implemented using a processor-based device programmed to send/receive various signals, commands, messages, etc. Each supervisor may be a standalone system or one or more supervisors may be implemented on a common platform (e.g., a server executing software for one or more supervisors). The supervisors may be local to the elevator system or coupled remotely via a network. The supervisors may be components of an elevator control system or elevator management system.

The lane supervisor 120 commands vertical motion of the elevator car 14 in one or more lanes, such as lanes 17 and 15. The lane supervisor 120 may enable or disable zones of the propulsion system to allow or prevent vertical movement of the elevator car 14 in a lane 17 and 15. Similarly, the transfer supervisor 130 commands horizontal movement of the elevator car 14 with the transfer station 32. The transfer supervisor 130 can enable or disable portions of the transfer station 32 to allow or prevent horizontal movement of the elevator car 14 in the transfer station 32. A carriage 33 may be employed to move the elevator car 14 in a horizontal direction bidirectionally between lanes 17 and 15.

The elevator system 10 includes intersections between a lane and the transfer station. As shown in FIG. 3, a first intersection 101 is located at the intersection of lane 17 and transfer station 32. A second intersection 102 is located at the intersection of lane 15 and transfer station 32. In operation, the group supervisor 110 ensures that only one of horizontal motion and vertical motion of the elevator car 14 is enabled within each intersection 101 and 102 at any time. Further, both horizontal motion and vertical motion of the elevator car 14 may be disabled within one or both intersections 101 and 102.

The lane supervisor 120 may be responsible for vertical movement in one or more lanes, and ensures that all vertical motion within a lane is only in enabled zones, and that all motion within enabled zones is conflict free. The transfer supervisor 130 ensures that all horizontal motion within the transfer station 32 is only in enabled zones, and that all motion within enabled zones is conflict free. Note that the boundaries of the lane zones and transfer zones used to ensure conflict-free operation do not necessarily coincide with the boundaries of the zones of the propulsion system.

The group supervisor 110 communicates with the lane supervisor 120 and the transfer supervisor 130 to ensure that travel of the elevator car 14 into and out of the transfer station 32 is conflict free (e.g., no other cars in path, transfer station carriage in proper position, etc.). The lane supervisor 120 and the transfer supervisor 130 may await commands from the group supervisor 110 prior to enabling or disabling movement of the elevator car. In alternate embodiments, the lane supervisor 120 and the transfer supervisor 130 communicate directly to prevent conflicts in movement of the elevator cars 14.

FIGS. 4A-4E depict control of travel of an elevator car 14 in an exemplary embodiment. In the example of FIGS. 4A-4E, an elevator car 14 is scheduled to travel vertically downwards in lane 17, enter the first intersection 101 and travel horizontally to the second intersection 102, and then travel vertically upwards in lane 15. It is understood that a wide variety of other operations may be performed by the control system, and the sequence of FIGS. 4A-4E is illustrative of one exemplary sequence.

Figure 4A:
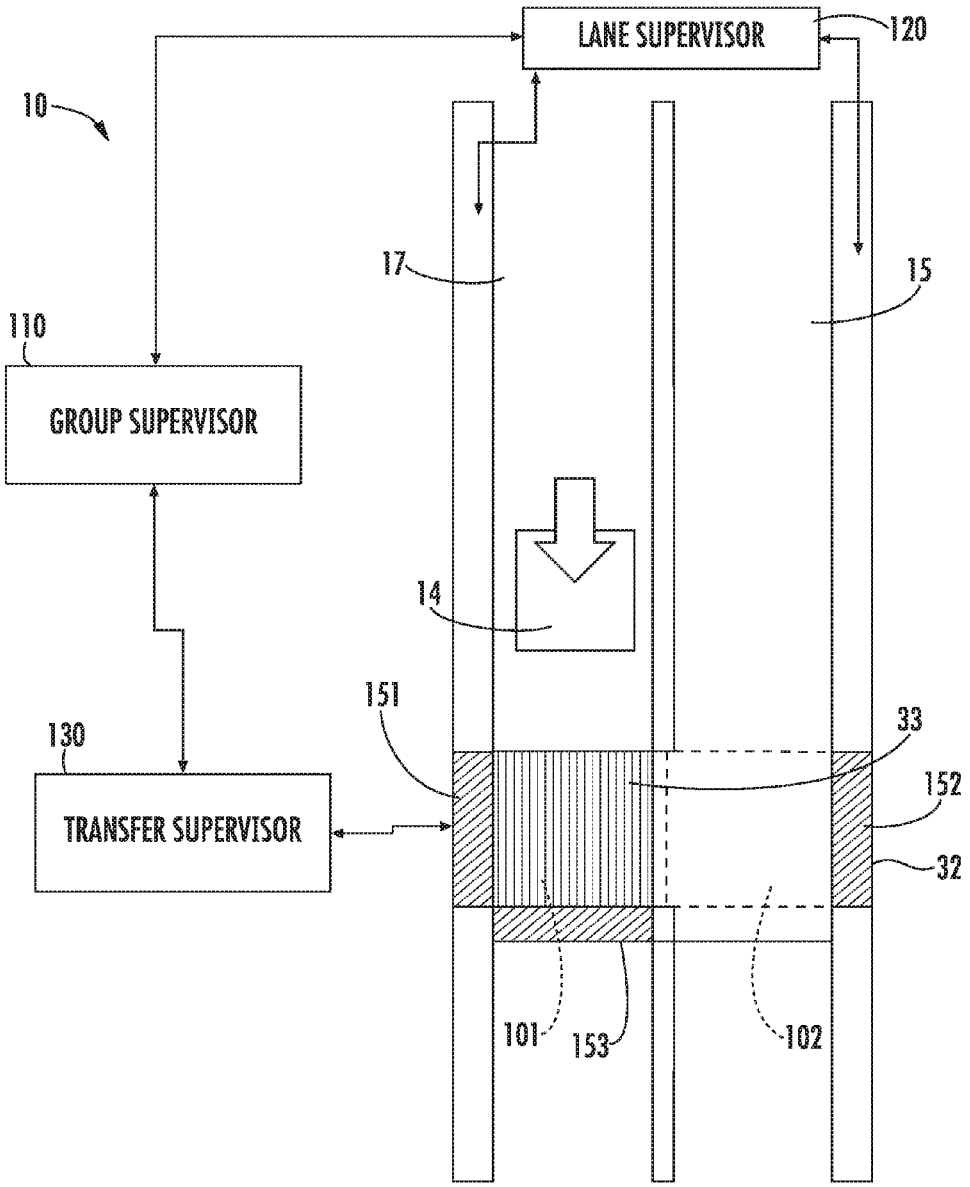
FIGS. 4A-4E depict control of elevator car travel in an exemplary embodiment.
Figure 4B:
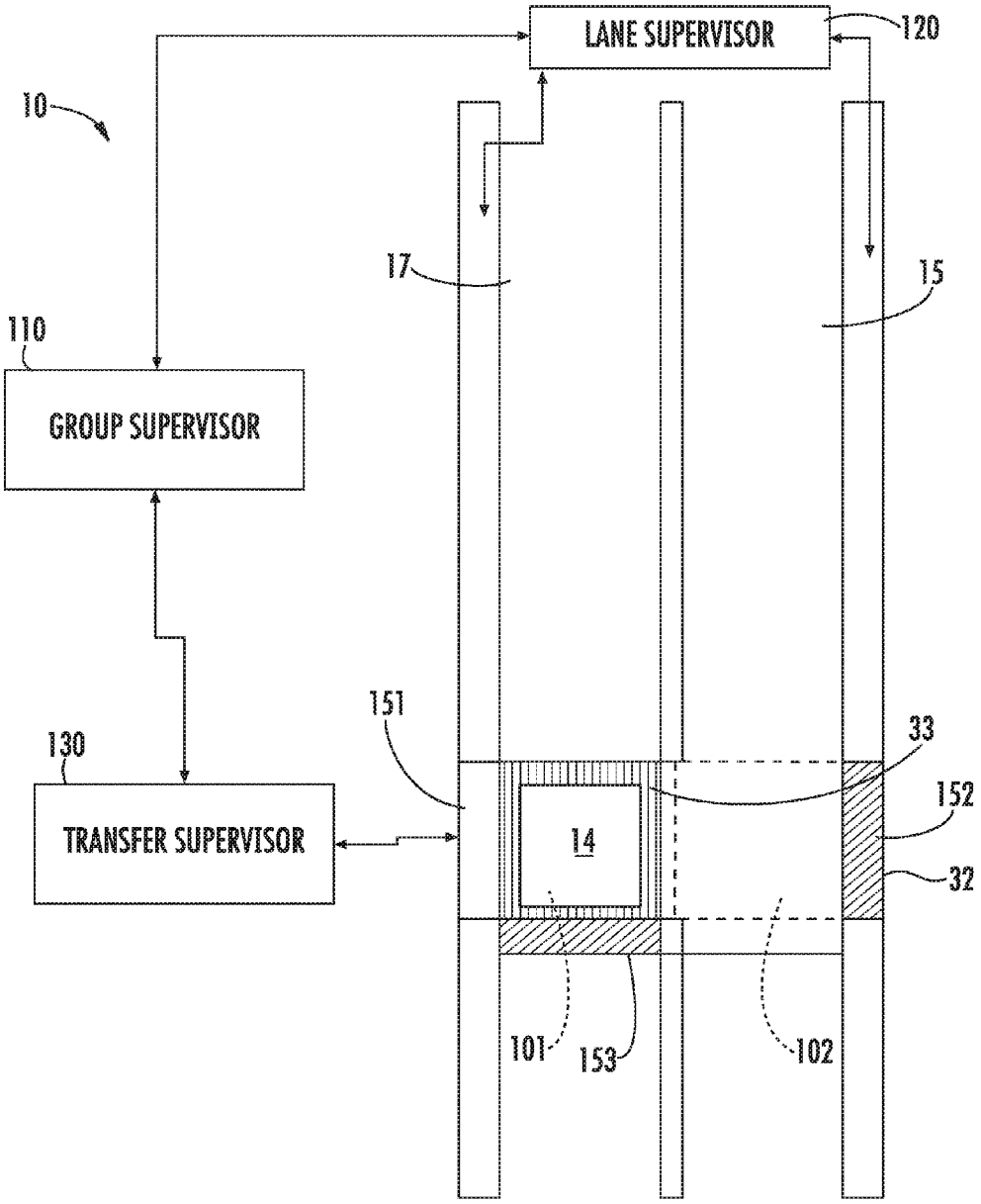

FIG. 4A shows an initial state with the elevator car 14 traveling vertically downwards in the lane 17 approaching the first intersection 101. A lane zone 151 in the first intersection 101 is in a disabled state (as depicted by cross hatching). Disabling or enabling a lane zone in the first intersection 101 refers to preventing or allowing motion of the elevator car 14 in a portion of lane 17 located in the first intersection 101. This may be performed by commanding the lane supervisor 120 to disable or enable travel of the elevator car 14 in that portion of the lane. Similar commands may be used to prevent or allow motion of the elevator car 14 in a portion of the lane 15 located in the second intersection 102.

The group supervisor 110 may also command the lane supervisor 120 to disable a lane zone 152 in the second intersection 102 (as depicted by cross hatching), to prevent elevator cars in lane 15 from entering the transfer station 32. The group supervisor 110 also commands the transfer supervisor 130 to disable a transfer zone 153 in first intersection 101 (as depicted by cross hatching). Disabling the transfer zone 153 prevents any horizontal movement of the elevator car 14 into or out of the first intersection 101. Disabling or enabling a transfer zone in the first intersection 101 refers to preventing or allowing horizontal motion of the elevator car 14 in a portion of the transfer station 32 located in the first intersection 101. This may be performed by commanding the transfer supervisor 120 to disable or enable commands to move the carriage 33 in that portion of the transfer station. Similar commands may be used to prevent or allow horizontal motion of the elevator car 14 in a portion of transfer station 32 located in the second intersection 102.

The group supervisor 110 may communicate with the transfer supervisor 130 to confirm that there are no other elevator cars in the transfer station 32 and that the carriage 33 is in the proper position in the lane 17. Once the transfer supervisor 130 confirms that these conditions are met, the group supervisor 110 commands the lane supervisor 120 to enable the lane zone 151 in first intersection 101, as depicted by a lack of cross hatching in FIG. 4B. The elevator car 14 may then move into the intersection 101. At this point, the transfer zone 153 in the first intersection 101 is still disabled, preventing horizontal movement into or out of the first intersection zone 101.

Figure 4C:
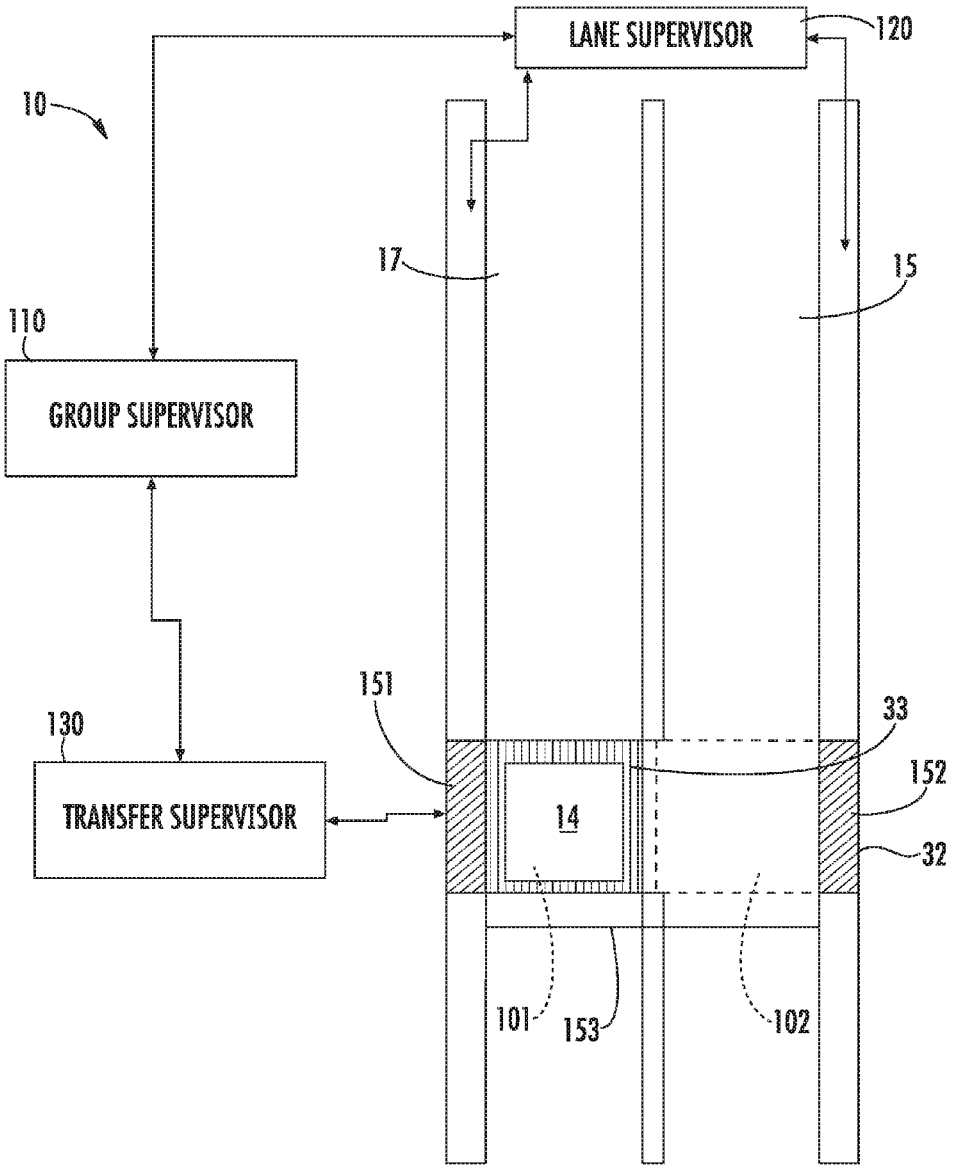
Figure 4D:
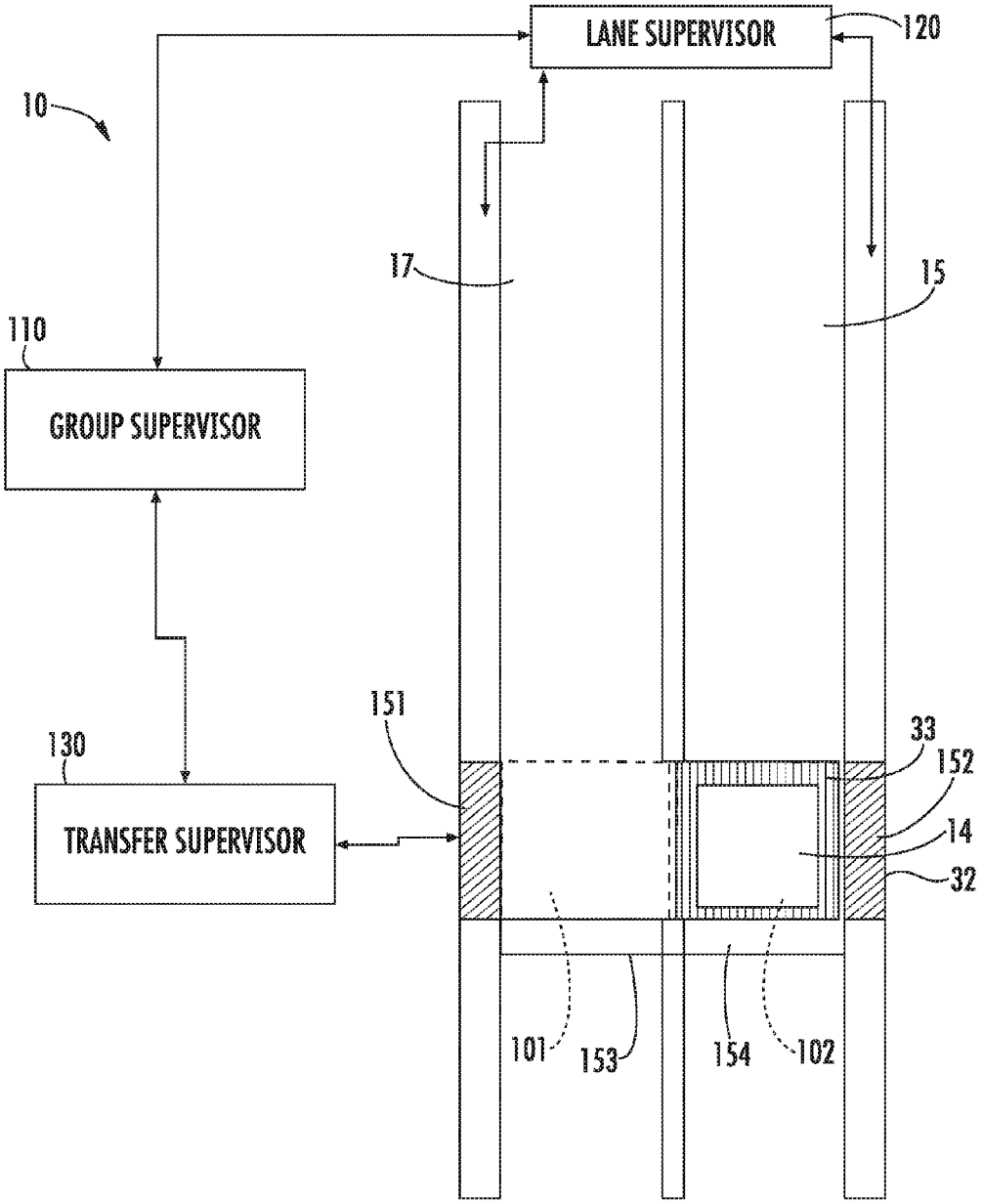
Figure 4E:
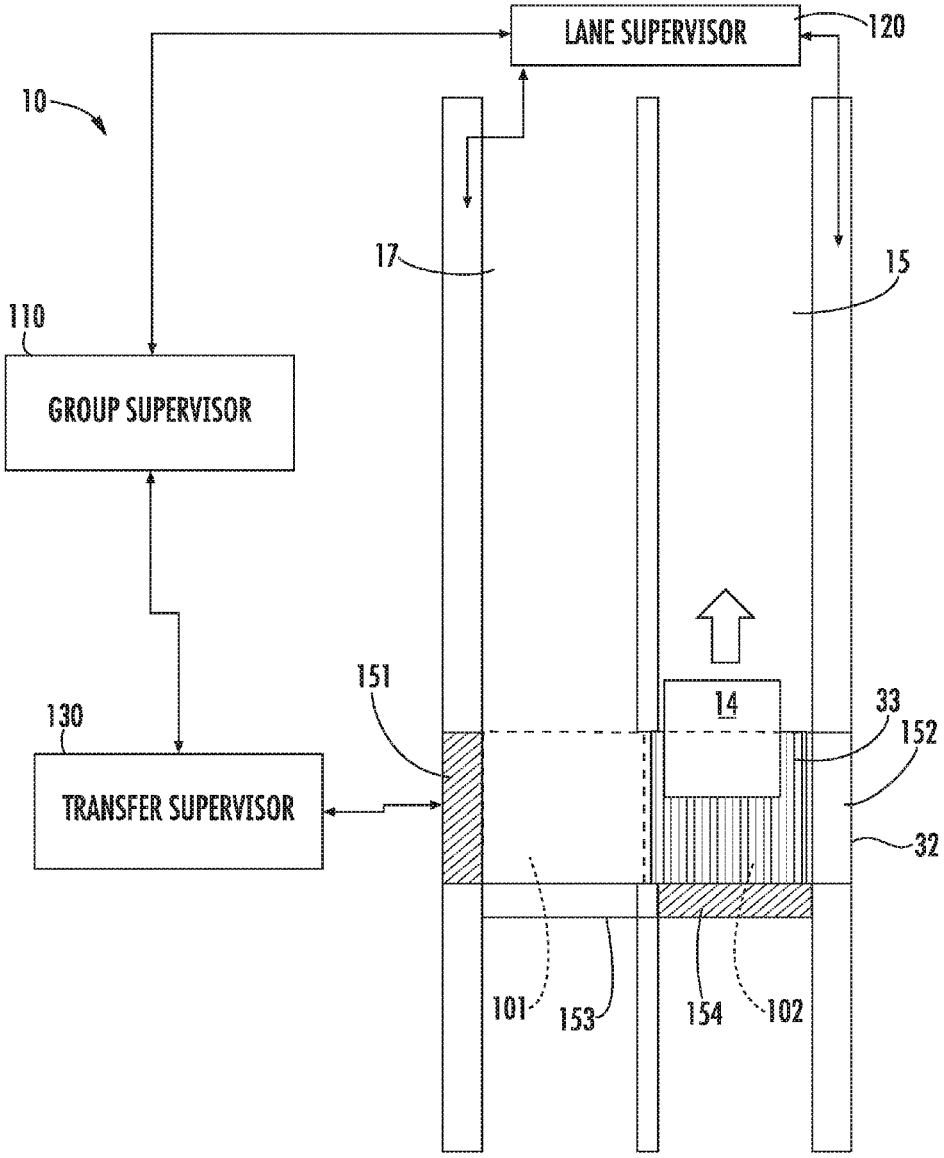

Once the elevator car 14 is in the first intersection 101, the group supervisor 110 commands the lane supervisor 120 to disable the lane zone 151 in first intersection 101, as depicted by cross hatching in FIG. 4C. This prevents another elevator car in lane 17 from entering the intersection 101. The group supervisor 110 may communicate with the transfer supervisor 130 to confirm that the carriage 33 may be moved horizontally from intersection 101 to intersection 102. If a transfer is allowed, the group supervisor 110 commands the transfer supervisor 130 to enable a transfer zone 153 in the first intersection 101 (as depicted by a lack of cross hatching in FIG. 4C). The lane zone 152 in second intersection 102 is still disabled, preventing the carriage 33 from entering the second intersection from lane 15. FIG. 4D depicts relocation of the carriage 33 and the elevator car 14 from the first intersection 101 to the second intersection 102.

When the elevator car 14 and the carriage 33 are moved into the second intersection 102, the group supervisor 110 communicates with one or both of the lane supervisor 120 and the transfer supervisor 130 to confirm that the elevator car 14 is ready to travel vertically upwards in lane 15. This may include the transfer supervisor 130 confirming that the carriage 33 is in a proper position and the elevator car 14 is free to travel upwards and the lane supervisor 120 confirming there are no cars in lane 15 that would interfere with the elevator car 14. If vertical travel conditions are met, then the group supervisor 110 commands the lane supervisor 120 to enable the lane zone 152 in the second intersection 102, as depicted by lack of cross hatching in FIG. 4E. The group supervisor 110 may communicate with the transfer supervisor 130 to disable the transfer zone 154 in the second intersection 102 (as depicted by cross hatching in FIG. 4E). The elevator car 14 may now be moved vertically upwards in lane 15.

The control system uses handshaking between the group supervisor 110, the lane supervisor 120 and the transfer supervisor 130 to ensure successful delivery of messages to the intended recipient and provide conflict free travel of elevator cars 14 into, within and out of a transfer station 32. Numerous conditions and commands may be communicated between the group supervisor 110, the lane supervisor 120 and the transfer supervisor 130 and confirmation is needed to ensure that each step of the transfer process is conflict free. The lane supervisor 120 and the transfer supervisor 130 may report on conditions in a lane or transfer station and then relinquish control to the group supervisor 110 and await a command from the group supervisor 110. In this manner, the group supervisor 110 supervises operation of the lane supervisor 120 and the transfer supervisor 130 to avoid conflicts between the elevator cars 14. The communications between the group supervisor 110, lane supervisor 120 and the transfer supervisor 130 may include acknowledge messages and/or periodic status messages.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system, comprising:

an elevator car to travel vertically in a first lane and a second lane;

a propulsion system to impart force to the elevator car;

a transfer station to move the elevator car horizontally from the first lane to the second lane; and a control system to supervise travel of the elevator car, the control system to supervise a first intersection between the first lane and the transfer station such that no more than one of vertical elevator car travel and horizontal elevator car travel is permitted at the first intersection at a given time.

2. The elevator system of claim 1 wherein:

the control system is configured to supervise the first intersection such that neither of vertical elevator car travel and horizontal elevator car travel is permitted at the first intersection at a given time.

3. The elevator system of claim 1 wherein:

the control system is configured to supervise a second intersection between the second lane and the transfer station such that no more than one of vertical elevator car travel and horizontal elevator car travel is permitted at the second intersection at a given time.

4. The elevator system of claim 3 wherein:

the control system is configured to supervise the second intersection such that neither of vertical elevator car travel and horizontal elevator car travel is permitted at the second intersection at a given time.

5. An elevator system, comprising:

an elevator car to travel vertically in a first lane and a second lane;

a propulsion system to impart force to the elevator car;

a transfer station to move the elevator car horizontally from the first lane to the second lane; and a control system to supervise travel of the elevator car, the control system to supervise a first intersection between the first lane and the transfer station such that no more than one of vertical elevator car travel and horizontal elevator car travel is permitted at the first intersection at a given time;

the control system includes at least one lane supervisor to supervise vertical travel of the elevator car in the first lane and the second lane, at least one transfer supervisor to supervise horizontal travel in the transfer station and at least one group supervisor to command the lane supervisor and the transfer supervisor.

6. The elevator system of claim 5 wherein:

the group supervisor commands the transfer supervisor to disable a transfer zone in the first intersection prior to the elevator car vertically travelling into the first intersection.

7. The elevator system of claim 6 wherein:

the group supervisor commands the lane supervisor to enable the lane zone in the first intersection, to enable the elevator car to travel vertically into the first intersection.

8. The elevator system of claim 7 wherein:

(i) the group supervisor commands the lane supervisor to disable the lane zone in the first intersection, (ii) the lane supervisor relinquishes control of the lane zone after ensuring that there is no existing elevator car traveling within the lane zone, and (iii) the group supervisor commands the transfer supervisor to enable the transfer zone in the first intersection and enable a second intersection between the second lane and the transfer station, the elevator car traveling from the first intersection toward the second.

9. The elevator system of claim 8 wherein:

the group supervisor commands the transfer supervisor to disable the transfer zone in the second intersection and commands the lane supervisor to enable a lane zone in the second intersection to enable the elevator car to travel vertically in the second lane.

10. The elevator system of claim 5 wherein:

the group supervisor mediates control between the lane supervisor and the transfer supervisor, wherein at any given time only one of the lane supervisor and the transfer supervisor controls movement of the elevator car.

11. The elevator system of claim 5 wherein:

(i) the group supervisor commands one of the lane supervisor and the transfer supervisor to disable elevator car movement in the first intersection, (ii) the one of the lane supervisor and the transfer supervisor relinquishing control of elevator car movement in the first intersection after ensuring that there is no existing elevator car travel within the first intersection, and (iii) the group supervisor commands the other of the lane supervisor and the transfer supervisor to enable elevator car travel within the first intersection.

12. A method of controlling an elevator system having an elevator car to travel vertically in a first lane and a second lane and a transfer station to move the elevator car horizontally from the first lane to the second lane, the method comprising:

controlling a first intersection between the first lane and the transfer station such that no more than one of vertical elevator car travel and horizontal elevator car travel is permitted at the first intersection at a given time.

13. The method of claim 12 further comprising:

controlling the first intersection such that neither of vertical elevator car travel and horizontal elevator car travel is permitted at the first intersection at a given time.

14. The method of claim 12 further comprising:

controlling a second intersection between the second lane and the transfer station such that no more than one of vertical elevator car travel and horizontal elevator car travel is permitted at the second intersection.

15. The method of claim 14 further comprising:

controlling the second intersection such that neither of vertical elevator car travel and horizontal elevator car travel is permitted at the second intersection.

16. A method of controlling an elevator system having an elevator car to travel vertically in a first lane and a second lane and a transfer station to move the elevator car horizontally from the first lane to the second lane, the method comprising:

controlling a first intersection between the first lane and the transfer station such that no more than one of vertical elevator car travel and horizontal elevator car travel is permitted at the first intersection at a given time;

disabling a transfer zone in the first intersection prior to the elevator car vertically travelling into the first intersection.

17. The method of claim 16 further comprising:

enabling the lane zone in the first intersection, to enable the elevator car to travel vertically into the first intersection.

18. The method of claim 17 further comprising:

(i) disabling the lane zone in the first intersection (ii) ensuring that there is no existing elevator car traveling within the lane zone and (iii) enabling the transfer zone in the first intersection and enabling the transfer zone in a second intersection between the second lane and the transfer station, the elevator car traveling from the first intersection toward the second intersection.

19. The method of claim 18 further comprising:

disabling the transfer zone in the second intersection and enabling a lane zone in the second intersection to enable the elevator car to travel vertically in the second lane.

* * * * *